US006550993B2

(12) United States Patent
Lu et al.

(10) Patent No.: US 6,550,993 B2
(45) Date of Patent: Apr. 22, 2003

(54) KEYBOARD STRUCTURE WITH LATCH SECTIONS AND RETAINING SECTIONS

(75) Inventors: Kevin Lu, Hsin-Tien (TW); Ching-Hsiang Chen, Hsin-Tien (TW)

(73) Assignee: Shin-Jiuh Corp., Taipei Hsien (TW)

( * ) Notice: Subject to any disclaimer, the term of this patent is extended or adjusted under 35 U.S.C. 154(b) by 0 days.

(21) Appl. No.: 09/940,892

(22) Filed: Aug. 29, 2001

(65) Prior Publication Data

US 2003/0044214 A1 Mar. 6, 2003

(51) Int. Cl.[7] ..... B41J 5/12; B41J 5/14
(52) U.S. Cl. ..... 400/490; 400/496
(58) Field of Search ..... 200/344, 345; 400/490, 491.2, 496

(56) References Cited

U.S. PATENT DOCUMENTS 5,399,822 A * 3/1995 Sato et al. ..... 200/344
5,994,655 A * 11/1999 Tsai ..... 200/344
6,448,520 B1 * 9/2002 Inoue ..... 200/344
2002/0014398 A1 * 2/2002 Ito et al. ..... 200/344
2002/0071245 A1 * 6/2002 Hsu ..... 361/680

* cited by examiner

*Primary Examiner*—Daniel J. Colilla
(74) *Attorney, Agent, or Firm*—Bacon & Thomas

(57) ABSTRACT

An improved keyboard structure consists of a lower plate, a membrane circuit, an upper plate, a bridge means, an elastic element and a key cap. The lower plate has a set of symmetrical first latch sections and a set of retaining sections formed at selected locations corresponding to the first latch sections. The upper plate has a set of symmetrical second apertures corresponding to the first latch sections and a set of symmetrical second latch sections corresponding to the second apertures. There are openings in front of the second latch sections for housing the retaining sections. The bridge means has a first pivotal end insertable in a biased manner into a space formed between the second latch section and the retaining sections and a second pivotal end latching to the first latch sections such that the bridge means can be assembled on the upper plate and the lower plate in single direction. The upper plate may be pushed to move the second latch sections away from the first pivotal end for removing the bridge means.

7 Claims, 5 Drawing Sheets

PRIOR ART Fig. 1

KEYBOARD STRUCTURE WITH LATCH SECTIONS AND RETAINING SECTIONS

FIELD OF THE INVENTION

The present invention relates to an improved keyboard structure and particularly a keyboard structure that allows assembling button keys on the keyboard in one direction.

BACKGROUND OF THE INVENTION

The commonly used keyboards on notebooks computers nowadays generally consists of a metal plate, at least one membrane circuit, an insulation sheet, a bridge means, an elastic element and a key cap. When assembling the keyboard, mount the membrane circuit and insulation sheet to the metal plate, then use the latch sections a, b, c, d, e (five feet positions) to pivotally engage the bridge means (as shown in FIG. 1), then assemble the elastic element and key cap in sequence to complete the assembly of the keyboard.

The five latch sections are located independently on the same metal plate. The latch sections a, b face one direction, latch sections c, d face another direction. As a result, assembly is difficult. In the event of error happened during assembling the bridge means, or malfunction or damages incurred, it is difficult to disassemble the bridge means. In many cases, the bridge means have to be removed by destructive approaches.

SUMMARY OF THE INVENTION

The primary object of the invention is to resolve the foregoing disadvantages. The invention provides a novel keyboard structure that allows the bridge means be assembled and disassembled in single direction.

Another object of the invention is to provide a single direction assembly and disassembly bridge means to allow the bridge means easy to assemble or disassemble on the metal plate.

A further object of the invention is to save assembly time and processes to reduce production costs.

To attain the foregoing objects, the invention separates the conventional metal plate to a lower plate and an upper plate. The lower plate has a set of symmetrical first latch sections and a set of retain sections formed at selected locations corresponding to the first latch sections. The upper plate has a set of symmetrical second apertures corresponding to the first latch sections and a set of symmetrical second latch sections corresponding to the second apertures. The second latch sections have respectively an opening formed at the front end thereof to engage with the retain section. The bridge means may be assembled on the upper and lower plate in one direction by inserting a pivotal end of the bridge means in a bias manner in a space formed between the second latch sections and retain sections, then engage another pivotal end of the bridge means to the first latch sections. For disassembly, push the upper plate to move the second latch sections away from the pivotal end for a selected distance, the bridge means may be removed easily.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
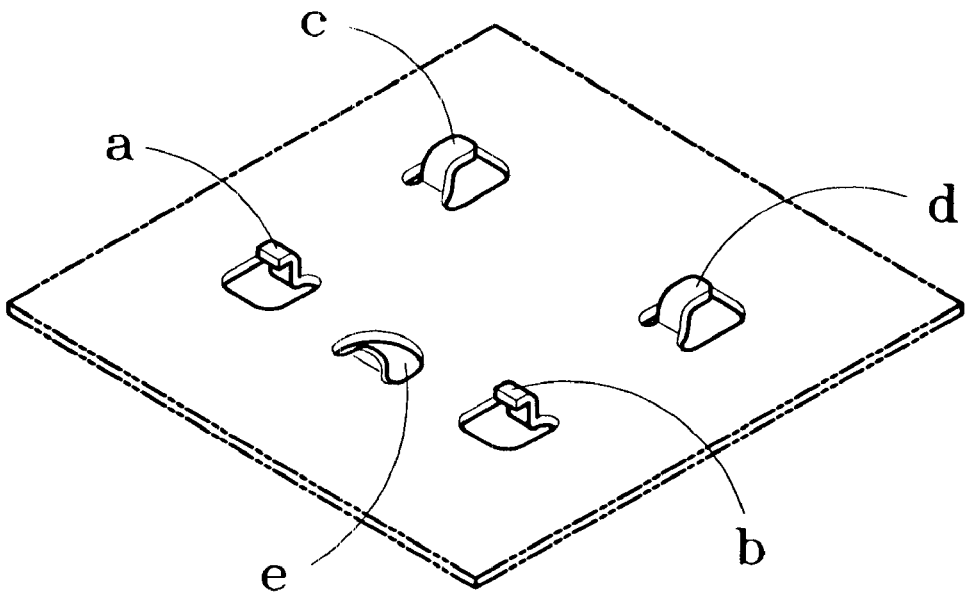
FIG. 1 is a fragmentary schematic view of a conventional base plate of a keyboard.
Figure 2:
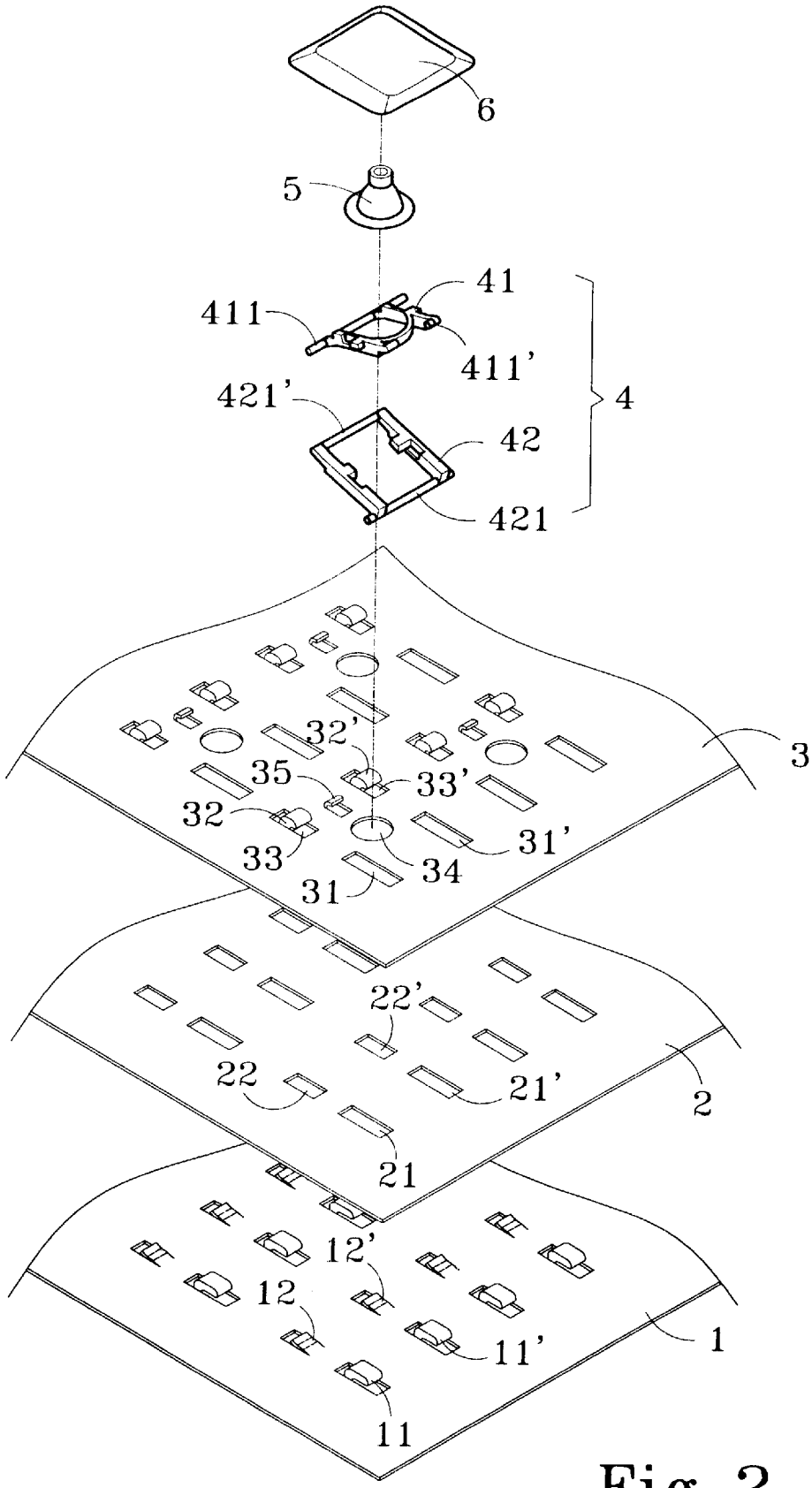
FIG. 2 is a schematic exploded view of a keyboard of the invention.

Referring to FIGS. 2, the keyboard of the invention consists of a lower plate 1, a membrane circuit 2, an upper plate 3, a bridge means 4, an elastic element 5 and a key cap 6. After the lower plate 1 and the upper plate 3 are coupled, the bridge means 4 can be rapidly assembled on or disassembled on the coupled lower plate 1 and upper plate 3.

The lower plate 1 has a set of symmetrical first latch: sections 11, 11', and a set of retain section 12, 12' formed at selected locations corresponding to the first latch sections 11, 11'.

The membrane circuit 2 has first apertures 21, 21', 22, 22' matching the first latch sections 11, 11' and retain sections 12, 12'.

The upper plate 3 has a set of symmetrical second apertures 31, 31' corresponding to the first latch sections 11, 11' and a set of symmetrical second latch sections 32, 32' corresponding to the second apertures 31, 31'. There are openings 33, 33' in front of the second latch sections 32, 32' for housing the retain sections 12, 12'. There is also a third aperture 34 formed between the second apertures 31, 31' and second latch section 32, 32'. Between the second latch section 32, 32', there is an anchor section 35 for anchoring the bridge means 4.

The bridge means 4 includes a first bracket 41 and a second bracket 42 pivotally engaged with each other in a cross manner. The first bracket 41 has a set of first pivotal ends 411, 411'. The second bracket 42 has a set of second pivotal ends 421, 421'. The first pivotal end 411 is pivotally engaged with the second latch sections 32, 32'. The, second pivotal end 421 is pivotally engaged with the first latch sections 11, 11'.

The elastic element 5 is made of soft rubber and mounted in the bridge means 4. The elastic element 5 has a depression section (not shown in the drawing) located therein which may pass through the third aperture 34 and depress the membrane circuit 2 when the elastic element 5 subjects to an external force for outputting a signal of the depressing key.

The key cap 6 is pivotally mounted to the bridge means 4. When the key cap 6 subjects to an external depressing force, the bridge means 4 will be moved downwards to depress the elastic element 5.

Figure 3A:
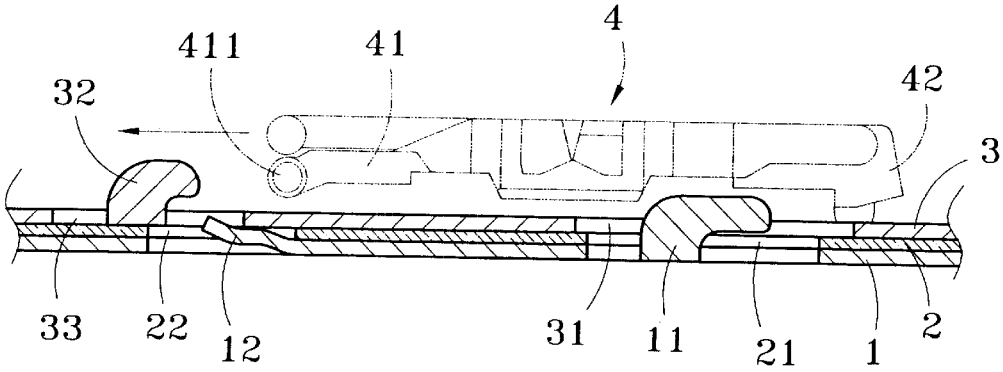
FIG. 3A is a schematic view of the invention under assembling.
Figure 3B:
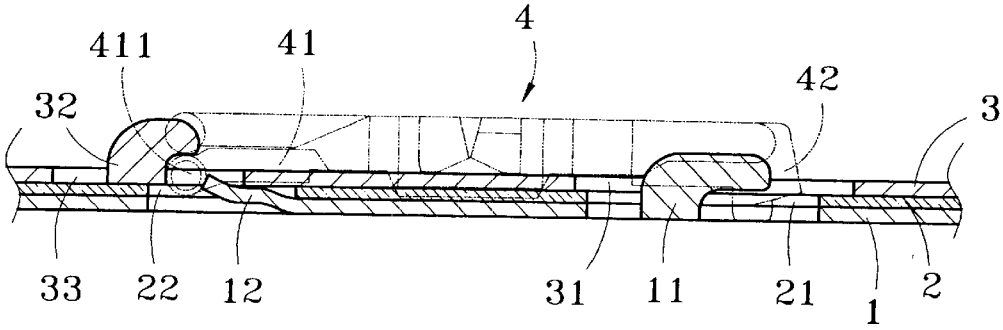
FIG. 3B is another schematic view of the invention under assembling.
Figure 4:
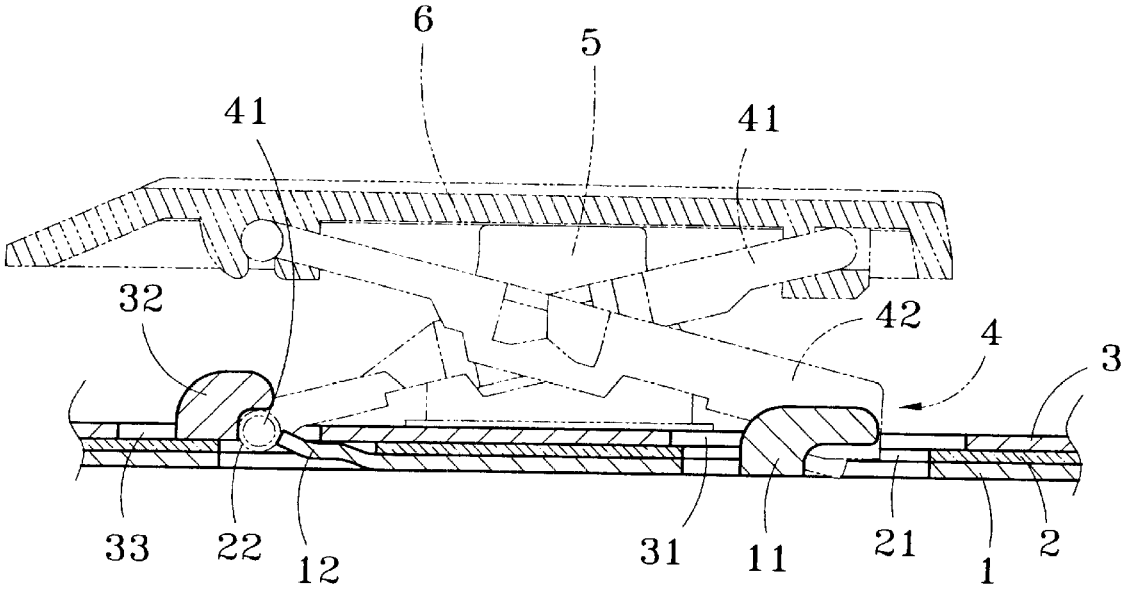
FIG. 4 is a schematic view of the invention, after assembled.

Referring to FIGS. 3A, 3B and 4 for assembly of the invention, first, couple and assemble the lower plate 1, membrane circuit 2 and upper plate 3. During assembling, dispose the first latch sections 11, 11' and retain sections 12, 12' through the first apertures 21, 21', 22, 22'. Then dispose the first latch sections 11, 11' through the second apertures 31, 31' of the upper plate 3, and the retain sections 12, 12' through the openings 33, 33' to match the second latch sections 32, 32'.

After the lower plate 1, membrane circuit 2 and upper plate 3 are assembled, insert the first pivotal end 411 of the first bracket 41 of the bridge means 4 in a bias manner into a space formed between the second latch sections 32, 32' and retain sections 12, 12'. Then wedge the second pivotal end 421 of the second bracket 42 in the first latch section 11, 11'. Thus the bridge means 4 will be assembled and secured on the lower plate 1 and upper plate 3. Then mount the elastic element 5 and key cap 6 in sequence to complete the assembly of the button key (as shown in FIG. 3).

Figure 5A:
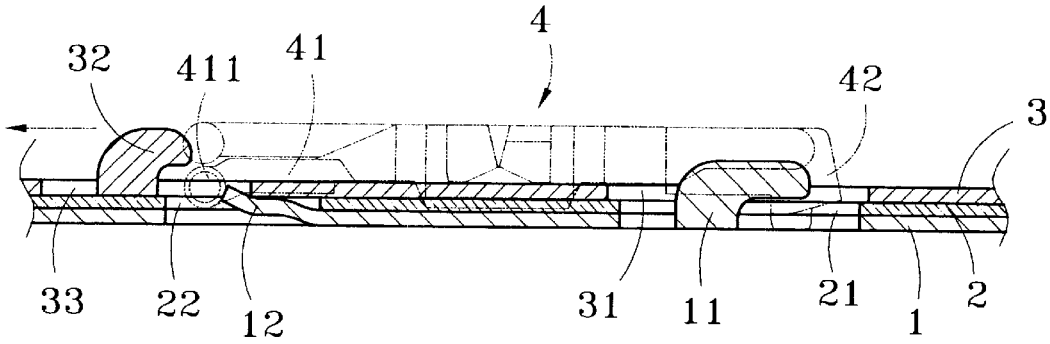
FIG. 5A is a schematic view of the invention under disassembling.
Figure 5B:
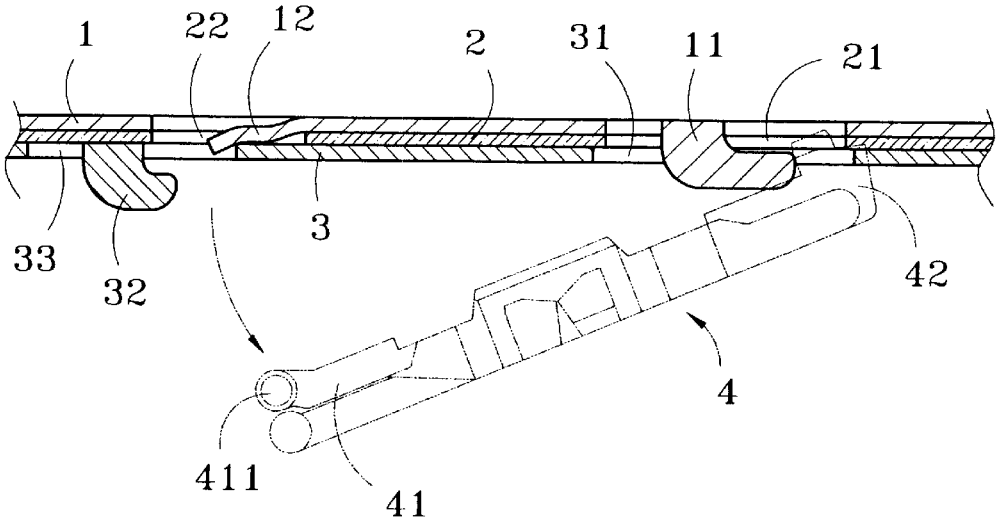
FIG. 5B is another schematic view of the invention under disassembling.

Referring to FIGS. 5A and 5B for disassembly of the invention, first, remove the key cap 6 and elastic element 5, then push the upper plate 3 to move the second latch sections of 32, 32' away from the first pivotal end 411 for a selected distance to disengage the first pivotal end 411 from the second latch sections of 32, 32' and retain sections 12, 12'. The first pivotal end 411 may be separated and removed from the second latch sections 32, 32' and retain sections 12, 12 easily (another alternative is to turn the upper and lower plate 3 and 1 upside down to allow the first pivotal end 411 dropping down automatically). Then disengage the second pivotal end 421 from the first latch sections 11, 11' to remove the bridge means 4 from the upper and lower plate 3, 1.

As assembly of the bridge means 4 on the lower plate 1 and upper plate 3 is done by inserting the bridge means 4 in single direction relative to the lower and upper plate 1, 3, it is simple and easy. When there is a need to remove the bridge means 4 such as for repairs or replacement, it also can be done easily. Thus production and assembly time and processes can be reduced, and production costs can be decreased.

What is claimed is:

1. An improved keyboard structure comprising a lower plate, a membrane circuit, an upper plate, a bridge means, an elastic element and a key cap, wherein:

the key cap is allowed to receive an external force for moving the bridge means downward to depress the elastic element and the membrane circuit to output a signal corresponding to the key cap;

the lower plate has a set of symmetrical first latch sections and a set of retaining sections formed at selected locations corresponding to the first latch sections; and the upper plate has a set of symmetrical apertures corresponding to the first latch sections, a set of symmetrical second latch sections corresponding to the apertures, and openings in front of the second latch sections for housing the retaining sections;

wherein the bridge means has a first pivotal end insertable in a bias manner into a space formed between the second latch section and the retaining sections, and a second pivotal end latching to the first latch sections such that the bridge means is assembled on the upper plate and the lower plate in a single direction; and the upper plate being movable to allow the second latch sections to separate from the first pivotal end for removing the bridge means.

2. The improved keyboard structure of claim 1, wherein the membrane circuit is interposed between the upper plate and the lower plate.

3. The improved keyboard structure of claim 1, wherein the membrane circuit is located above the upper plate.

4. The improved keyboard structure of claim 1, wherein the membrane circuit is located below the lower plate.

5. The improved keyboard structure of claim 1, wherein the membrane circuit has first apertures corresponding to the first latch section and the retaining sections.

6. The improved keyboard structure of claim 1, wherein the upper plate has another aperture located between the apertures and the second latch sections.

7. The improved keyboard structure of claim 1, wherein the upper plate further has an anchor section located between the second latch sections.

* * * * *